US005355824A

United States Patent [19]

Meyer et al.

[11] Patent Number: 5,355,824

[45] Date of Patent: Oct. 18, 1994

[54] SEAL DEVICE FOR FERROMAGNETIC CONTAINERS

[75] Inventors: Ross E. Meyer; Andrew J. Jason, both of Los Alamos, N. Mex.

[73] Assignee: The Regents of the University of California, Office of Technology Transfer, Alameda, Calif.

[21] Appl. No.: 163,617

[22] Filed: Dec. 7, 1993

[51] Int. Cl.[5] ..... B63B 43/16

[52] U.S. Cl. ..... 114/229

[58] Field of Search ..... 114/222, 227, 228, 229, 114/343; 220/230, 232; 405/12

[56] References Cited

U.S. PATENT DOCUMENTS

| | | | |
|---|---|---|---|
| 770,078 | 9/1904 | Kruger | 114/229 |
| 3,094,964 | 6/1963 | Witten et al. | 114/227 |
| 3,669,055 | 6/1972 | Buce | 114/229 |
| 4,161,155 | 7/1979 | Cloutier | 114/227 |
| 5,025,972 | 6/1991 | Finlan | 228/32 |
| 5,036,786 | 8/1991 | Uri | 114/229 |
| 5,165,356 | 11/1992 | Williams | 114/229 |
| 5,279,092 | 1/1994 | Williamsen et al. | 114/227 |

*Primary Examiner*—Stephen P. Avila
*Attorney, Agent, or Firm*—Ray G. Wilson

[57] ABSTRACT

A temporary seal or patch assembly prevents the escape of contents, e.g., fluids and the like, from within a container having a breach therethrough until the contents can be removed and/or a repair effected. A frame that supports a sealing bladder can be positioned over the breach and the frame is then attached to the container surface, which must be of a ferromagnet material, by using switchable permanent magnets. The permanent magnets are designed to have a first condition that is not attracted to the ferromagnetic surface and a second conditions whereby the magnets are attracted to the surface with sufficient force to support the seal assembly on the surface. Latching devices may be attached to the frame and engage the container surface with hardened pins to prevent the lateral movement of the seal assembly along the container surface from external forces such as fluid drag or gravity.

12 Claims, 5 Drawing Sheets

SEAL DEVICE FOR FERROMAGNETIC CONTAINERS

This invention was made with government support under Contract No. W-7405-ENG-36 awarded by the U.S. Department of Energy. The government has certain rights in the invention.

BACKGROUND OF THE INVENTION

This invention relates to seal devices for large vessels and other containers and, more particularly, to large area seals for attaching to a ferromagnetic structure.

It is well known that significant environmental damage can occur from the leakage of liquids stored in large containers, such as tankers and bulk carrier vessels and shore-based tanks. The breach of a supertanker hull, e.g., the EXXON Valdez disaster, can result in the release of millions of gallons of petroleum to an ecologically sensitive system or can contribute to the general pollution of waterways. In chemical storage areas located on shore, leaks can be contained about a storage vessel, but the chemicals might be absorbed in earth surrounding the containment area for subsequent migration to water supplies or might be released if the containment area is flooded, e.g., as occurred during the recent flooding of the Mississippi River system.

In all instances, the preferred corrective action is to stop the leak as soon as possible. Various devices have been developed for forming temporary patches over the area of the leak until a permanent patch can be made. Such devices include inflatable bladders, foam blankets, etc., that are mechanically held against the leak. Magnetic attachment offers many advantages for securing a temporary seal about a leak through a container of ferromagnetic material since the magnet is attracted directly to the surface for securing the seal to the surface. Some devices have used electromagnets to hold the patch to the surface of the leaking container. However, the use of electromagnets depends on the availability of electrical power and can be difficult to use in certain environments, e.g., underwater or explosive atmospheres.

In some applications, e.g., a leak in a tanker hull, the seal must remain in place as the container is moved. The drag forces induced as a ship moves through water can be substantial and any seal device must accommodate those forces in order to maintain the seal during movement.

Accordingly, it is an object of the present invention to provide a seal device that is attachable to a ferromagnetic surface using permanent magnets.

Another object of the present invention is to provide a seal device using permanent magnets having an attractive force on a ferromagnetic material that can be varied from a low level for seal placement about the leak and a high level for exerting a force about the periphery of the leak.

Yet another object of the present invention is to provide a seal device that will remain stationary above a leak if the container is moving, e.g., a ship hull during movement through water.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a seal device for sealing about a leak in a ferromagnetic container, i.e., a container made of a ferromagnetic material. The seal contains a frame that defines an internal area larger than the leak and a bladder secured to the frame that covers the internal area. A plurality of permanent magnets are spaced about the frame for attaching the frame to the ferromagnetic container. Each of the permanent magnets can be switched from a first magnetic condition that is not attracted to the ferromagnetic container and a second magnetic condition that is attracted to the ferromagnetic container. A seal is provided for sealing between the frame and the ferromagnetic container.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
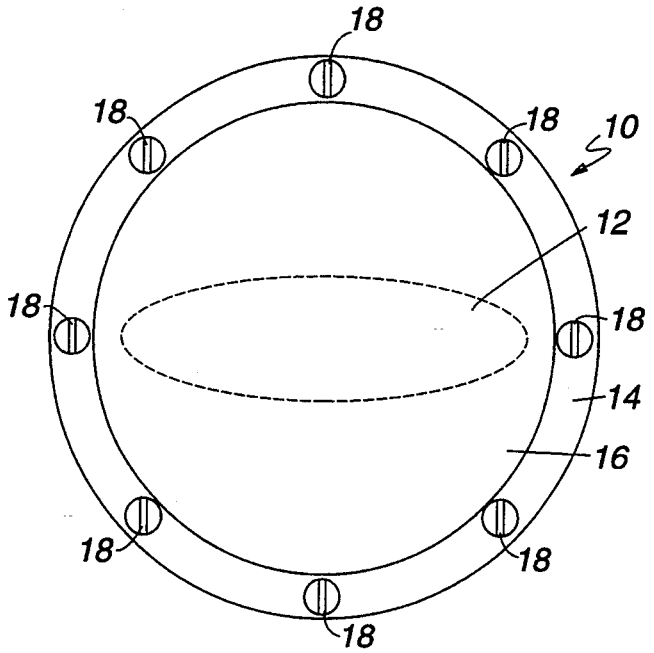
FIG. 1 is a plan view of one embodiment of a seal device according to one embodiment of the present invention for use over a relatively small leak.

Referring first to FIG. 1, there is shown in plan view a seal assembly 10 according to the present invention for providing a temporary seal or patch above a breach 12 in a container to prevent the escape of contents, i.e., fluids and the like, from within the container until the contents can be removed and/or a repair effected. Frame 14 defines an area that is large enough to cover breach 12. A flexible bladder 16 is connected to frame 14 using conventional fasteners, e.g., screws, bolts, rivets, or the like, and is effective to cover breach 12. Frame 14 is preferably flexible enough to conform to the contours of the container. In one embodiment, frame 14 is circular to provide maximum strength and rigidity. A seal member (not shown) is located between frame 14 and the underlying container.

Permanent magnets 18 are spaced about frame 14 and serve to support frame 14 on the container. As discussed below, magnets 18 apply sufficient magnetic force against the container to support the weight of frame 14 and, in some instances, to seal the underlying seal (not shown) against the container. It will be understood hereafter that the container must be constructed of a ferromagnetic material for the present invention to be used, while frame 14 is a nonferromagnetic material, e.g. fiberglass, graphite composite, other high-strength composites, and the like, so that the magnetic field from a magnet 18 is concentrated in the underlying container.

Seal assembly 10 may be initially supported by some external support and placed adjacent breach 12 or, if breach 12 is beneath the water line, may be made buoyant to enable manual handling of assembly 10. Permanent magnets 18 are formed to have a first magnetic condition, i.e., "turned off," where a magnet 18 will exert no attractive force, i.e., insufficient force to hold magnet 18 against the container, and a second magnetic condition, i.e., "turned on," where substantially the full strength of the magnet is between magnet 18 and the container.

Figure 2:
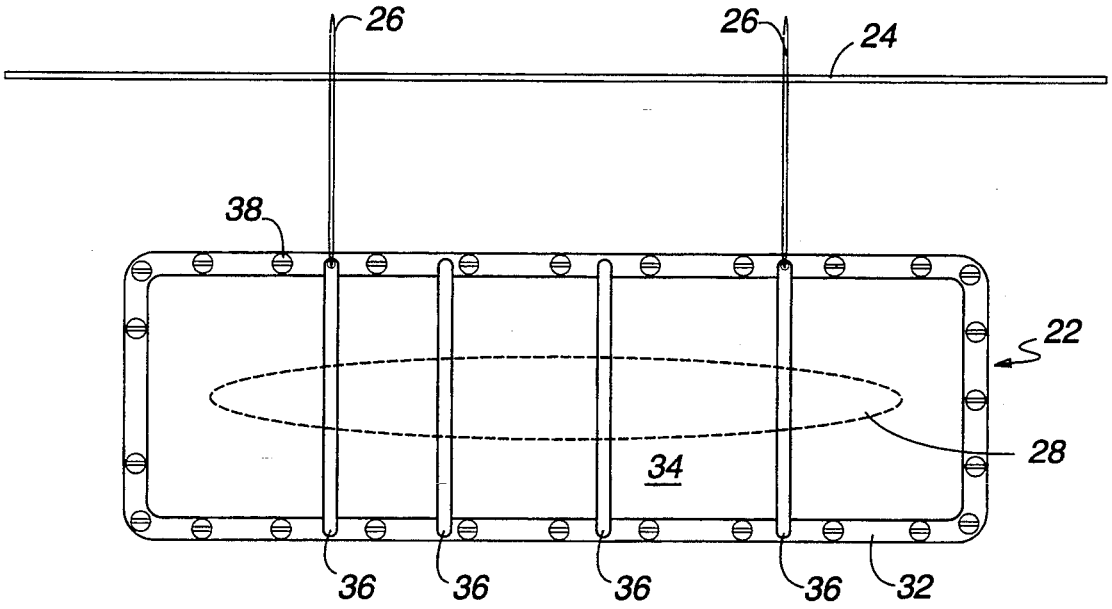
FIG. 2 is a plan view of a second embodiment of a seal device according to the present invention for use over a relatively large leak.

FIG. 2 depicts seal assembly 22 in plan view, wherein frame 32 is generally rectangular to define an area for elongated rips and tears, e.g., breach 28, and supports bladder 3,4 for containing fluid flow in or out of breach 28. A seal material (not shown) may be placed adjacent the container surface to impede the leakage of fluid from within seal assembly 2,2. As shown surface 24, which may be the deck of a ship, supports cables 26, which, in turn, support seal assembly 22 adjacent breach 28. Permanent magnets 38 are spaced about the perimeter of frame 32 to support seal assembly 22 on the underlying container. Magnets 38 are turned off during the initial positioning of seal assembly 22 over breach 28 and are turned on to support seal assembly 22 in place over breach 28. It will be appreciated that there may be substantial differential pressure across bladder 34 tending to extend bladder 34 with a concomitant inward movement of the sides of frame 32. In order to maintain the geometry of frame assembly 2,2 for adequate sealing contact between frame assembly 22 and the underlying container, spacer bars 36 may be provided for additional rigidity across breach 28.

Figure 3:
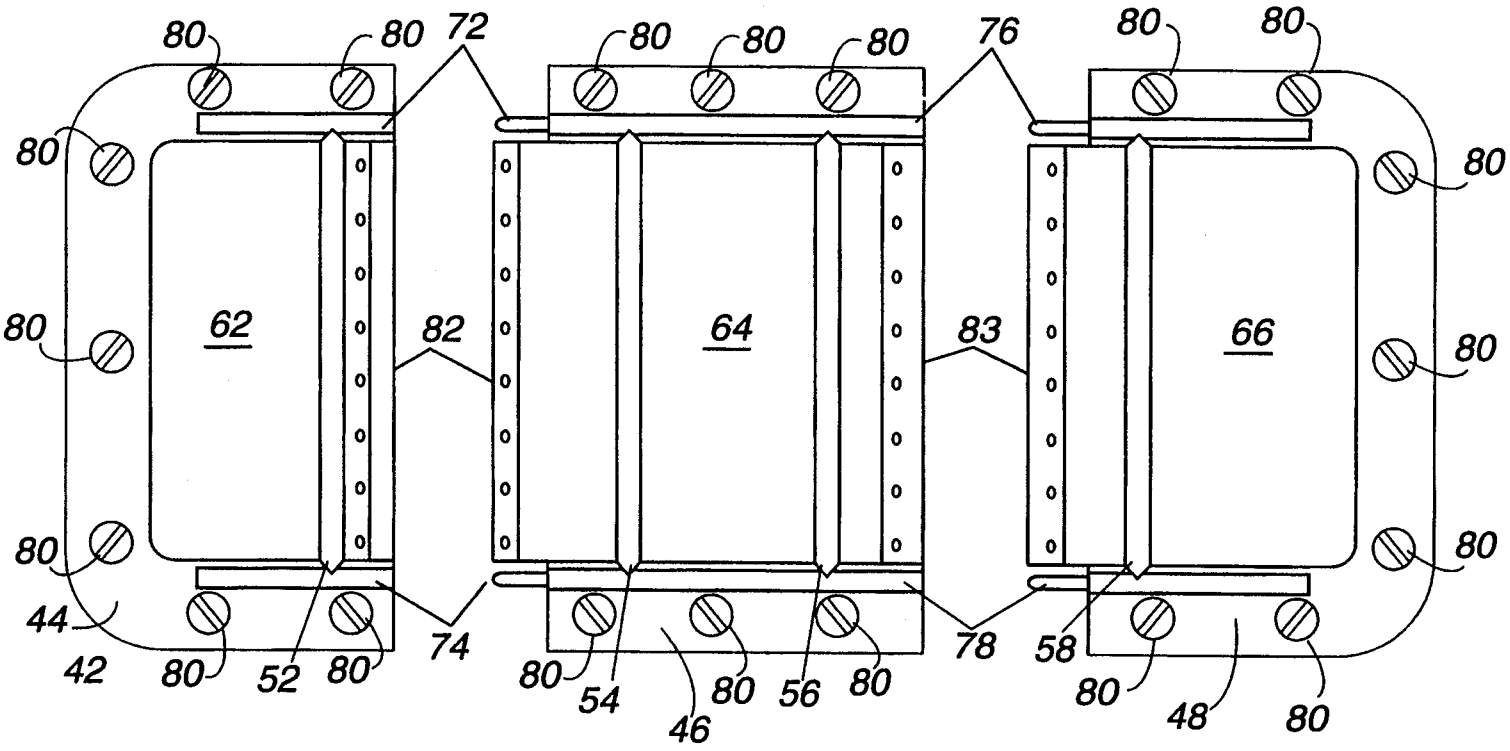
FIG. 3 is a plan view of a third embodiment of a seal device according to the present invention in sectional form for ease of transport and storage.

A modular design for a seal assembly 42 is shown in FIG. 3. Frame members 44 and 48 form end members for holding bladder members 62 and 66, respectively. Frame member 46 is exemplary of an intermediate section and holds bladder member 64. Spreader bars 52, 54, 566, and 58 maintain the rigidity of frame sections 4,4, 46, and 48. In one embodiment, frame sections 44, 46, and 48 are connected with bayonet-type connectors 72, 74, 76, and 78 to maintain section alignment and rigidity. The bayonet joints are secured by cotter pins or other suitable fastener. Adjacent modules are sealed together by any convenient method, e.g., overlapping surfaces 82, 83 that are bolted together, tongue and groove seals, abutting seals, etc. Permanent magnets 80 are provided on perimeter frame members 44, 46, and 48 for supporting the assembled frame assembly adjacent a leaking container breach.

Figure 4A:
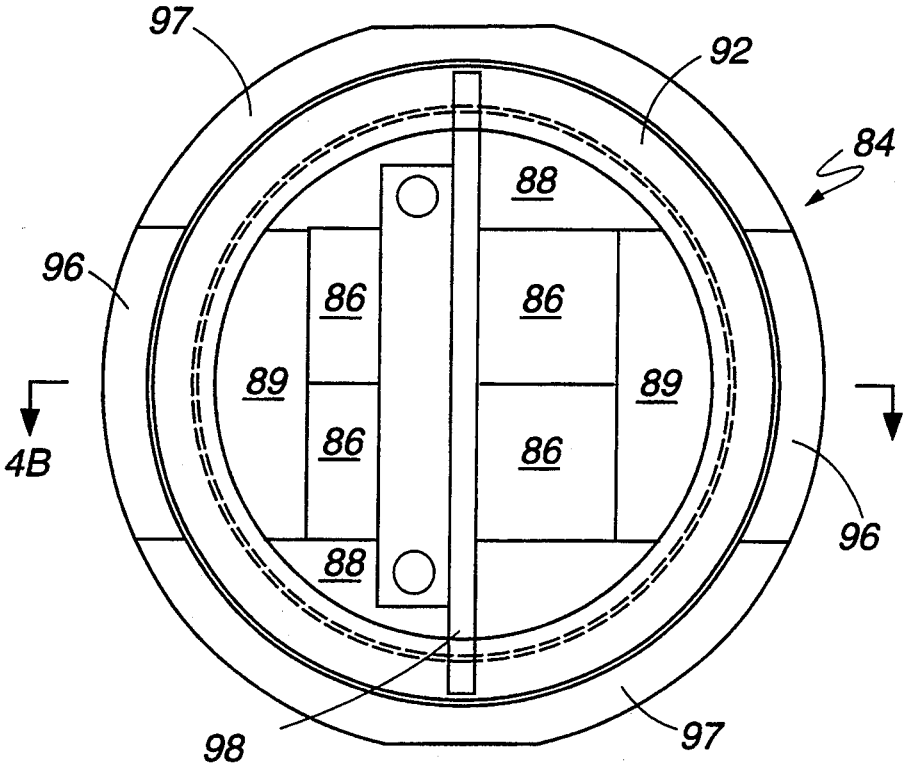
FIGS. 4A and 4B are plan and cross-sectional views, respectively, of one embodiment of a permanent magnet assembly according to the present invention.
Figure 4B:
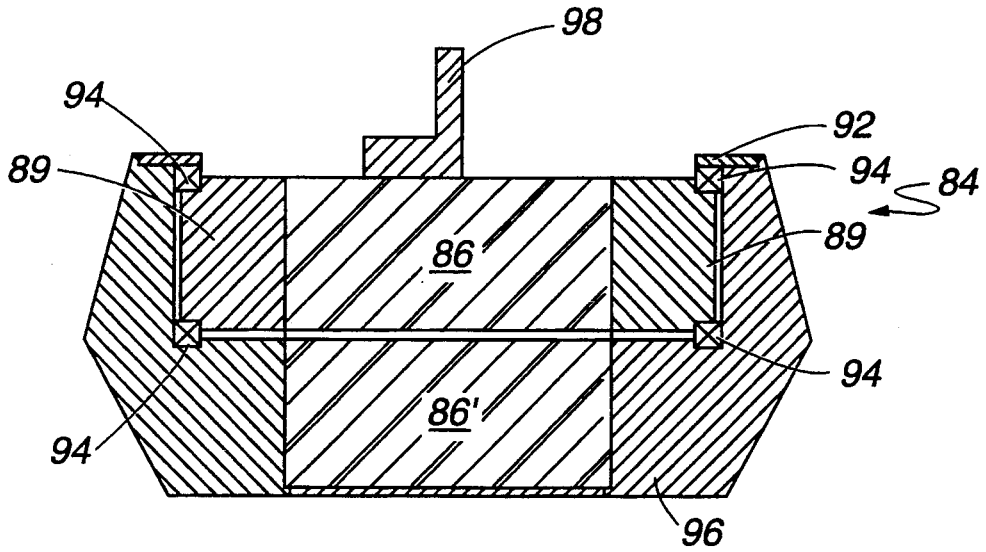

Referring now to FIGS. 4A and 4B, there are shown a plan view and cross-sectional view, respectively, of a preferred design of permanent magnet assembly 84 for use in the seal assemblies shown in FIGS. 1, 2, and 3, above. Conventional assembly components, such as alignment pins and fasteners, are omitted for clarity. Magnets 86, 86' are held by clamp pieces 88 and 89 within frame 96. As shown, magnets 86, 86' may be formed of several pieces of a ceramic magnetic material, e.g., samarium-cobalt or neodymium-iron, for ease of handling or may be formed of a single magnet if the magnetic field forces permit proper assembly. Suitable sources of magnets include Shin-Etsu Corp. and Permag Corp. The magnetic axes of magnets 86 and 86' are aligned along a left-right line in FIG. 4A. Magnets 86 and 86' clamp pieces 89, and frame members 96 are preferably coated with an epoxy material to prevent corrosion. Clamp pieces 89 and frame members 96 are formed from a magnetic material, e.g., mild steel; clamp pieces 88 and frame members 97 are formed from a nonmagnetic material, e.g., aluminum. Frame 96 and clamp pieces 89 cooperate to form a magnetic path to concentrate magnetic forces within an underlying container surface when magnets 86 and 86' are properly aligned.

In accordance with the present invention, magnets 86 and 86' are moveable relative to one another. In one embodiment, magnet 86 and clamp pieces 88, 89 are mounted on bearings 94 and held within frame 96, 97 by retainer 92. Thus, magnet 86 may be rotated relative to magnet 86' by rotating handle 9.8. If the magnetic poles of magnet 86 are aligned opposite from the magnetic poles of magnet 86', e.g., one north magnetic pole is over one south magnetic pole, then the magnetic field is confined to the magnets and does not extend into an adjacent ferromagnetic material and magnet assembly 84 is turned off. If magnets 86 and 86' are rotated to align the magnetic poles, e.g., a north pole is over a north pole, the magnetic field must now extend external to the magnets and exert an attracting force on an adjacent ferromagnetic surface beneath the magnetic path formed by clamp members 89 and frame members 96, i.e., the magnet is turned on. The ability to turn the magnet on and off permits the magnet to be easily manipulated adjacent a ferromagnetic surface without continually being attracted to the surface until it is appropriate to fix the magnet to the surface.

Figure 5A:
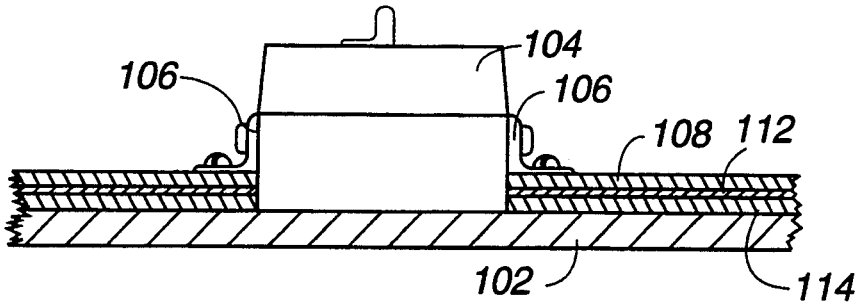
FIGS. 5A and 5B are side views of designs for sealing the device frame to a leaking container.
Figure 5B:
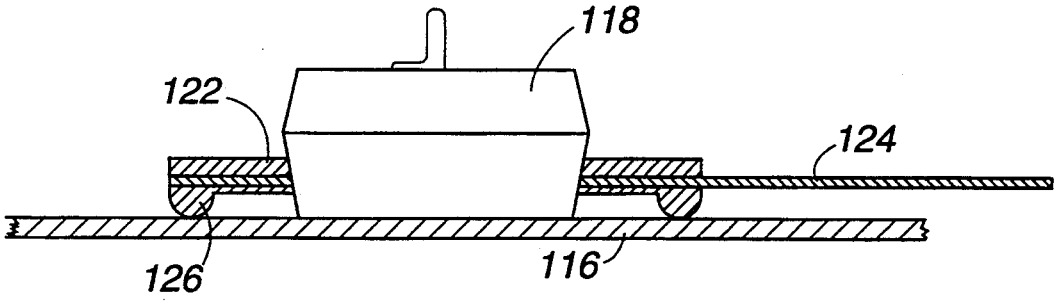

In order to minimize the continued leakage of fluid from within the temporary seals or patches discussed above, a seal or gasket is preferably placed between a frame and a container surface. FIGS. 5A and 5B illustrate in side view two arrangements for sealing between a seal assembly and a container surface.

FIG. 5A depicts magnet 104 attached to the surface of container 102 and extending through frame 108, bladder 112, and gasket 114. Gasket 114 is a conventional sheet material made of a strong resilient fabric material with appropriate chemical resistance, as discussed below, and is generally shaped to conform to frame 108. Magnet 104 is secured to frame 108 by a plurality of mounting brackets 106. In some underwater applications, where the cargo fluid is less dense than the surrounding sea water, the resulting force will act to urge the seal assembly against the container surface and form the desired seal between frame 108 and container 102. Then, magnet 104 acts to support the seal assembly but may not be required to exert a sealing force against gasket 114. Magnet 104 may then be mounted in bracket 106 in a sliding arrangement to permit magnet 104 to move relative to frame 108 to accommodate imperfections in the surface of container 102.

FIG. 5B depicts a sealing arrangement where magnet 118 is rigidly mounted in frame 122 and through bladder 124 so that sealing forces are provided by the attraction of magnet 118 to container 116. Seal gasket 126 is formed from a suitable resilient material as gasket 112 (FIG. 5A) and may now include suitable ribs that can be compressed to form an effective seal. As shown, magnet 118 is rigidly coupled to frame 122 and/or gasket 126 in the uncompressed state by brackets, adhesive, or other suitable means (not shown) so that attachment of magnet 118 to container 116 will cause portions of gasket 126 to compress and provide the desired seal.

It will be appreciated that there will situations where forces may act on the seal device that tend to move the seal device along the container surface, e.g., fluid drag from moving the container (i.e., moving a container ship through water) or from lack of sufficient friction force to prevent movement from, e.g., gravitational forces. Accordingly, FIGS. 6A, 6B, and 6C pictorially illustrate arrangements for securing a seal device over a container breach.

Figure 6A:
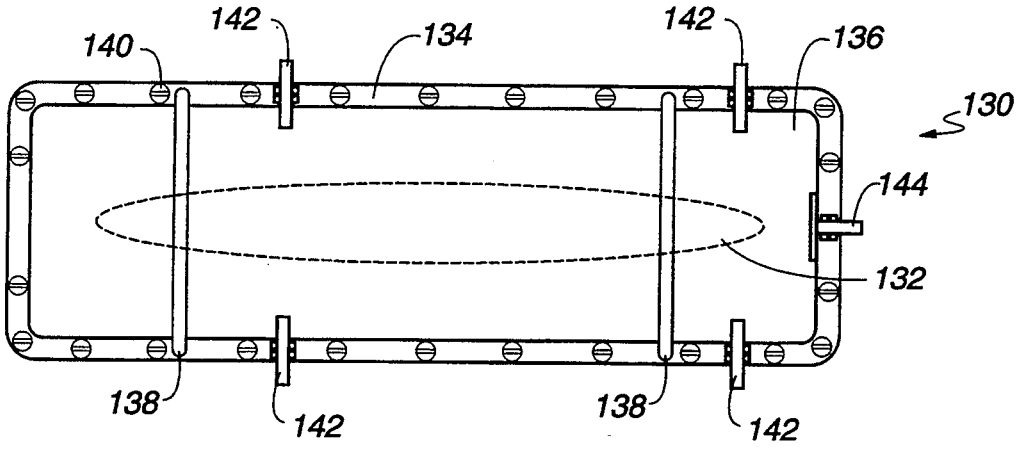
FIGS. 6A, 6B, and 6C are pictorial illustrations of latch mechanisms for holding a seal assembly in position over a container breach.

FIG. 6A illustrates seal device 130 positioned over a container breach 132. Frame 134 holds bladder 136 over breach 132 and the assembly is held against the container surface by the attractive force of magnets 140. Spreader bars 138 may be required to maintain the shape of frame 134 for sealing against the container. Vertical latches 142 prevent vertical movement of seal assembly 130 and drag latch 144 resists lateral movement of seal assembly 130 along the container surface where latches 142 and 144 are fixed to frame 134 and are operatively placed to contact the container surface.

Figure 6B:
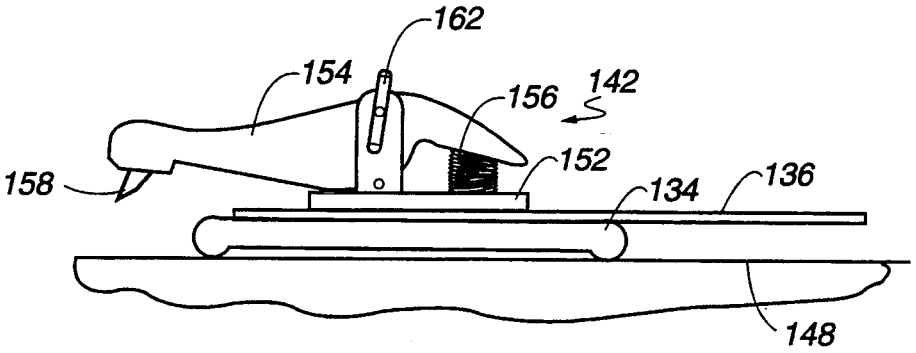

FIG. 6B pictorially depicts one embodiment of a vertical latch 142. Latch base 152 is fixed to frame 1 34, which supports bladder 136. Rocker arm 154 is pivotally mounted to base 152 and houses a pin 158 of hardened material that engages container surface 148. Pin 158 is urged against container surface 148 by the action of spring 156 on rocker arm 154. In a preferred embodiment, pin 158 may be held above surface 148 during the installation of seal assembly 130, e.g., by inserting latch pin 162 through aligned holes in base 152 and rocker arm 154.

Figure 6C:
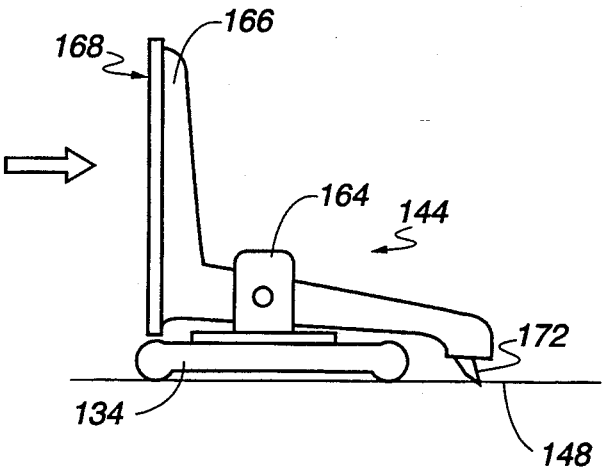

FIG. 6C pictorially depicts one embodiment of a drag latch 144. Base 164 is secured to frame 166. Rocker arm 166 is pivotally attached to base 164 and houses pin 172 of hardened material that engages container surface 148. Pin 172 is urged against surface 148 by the drag force of an adjacent fluid medium against surface 168 of rocker arm 166. Surface 168 is sized to generate a drag force that is sufficient to engage pin 172 with surface 148 so that lateral movement of seal bladder 130 does not occur.

The material for the bladders discussed for use in the illustrated embodiments is preferably a strong, lightweight, commercially-available material that can resist abrasions, punctures, and pressures of up to hundreds of pounds per square inch. One suitable material is a viton sheet material available from, e.g., McMaster-Carr, with a 1500 psi tensile strength, resistance to chemicals such as crude oil, a hardness of Shore A with durometer of 70–80, and with an operating temperature range of about −30° to 200° C. For other severe applications, and depending on other particular application requirements, e.g., high penetration resistance, other high strength materials, such as aramid fiber weaves (e.g., kevlar) permeated with or bonded to a perfluoroelastomer material (e.g., fluorel) for fluid permeability, may be selected.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A seal device for sealing about an area of a leak in the surface of a ferromagnetic container, comprising:

frame means defining an internal area larger than said area of said leak;

a bladder covering said internal area and secured to said frame means;

a plurality of permanent magnets spaced about said frame means for magnetic attachment to said surface of said ferromagnetic container, each said permanent magnet having a first magnetic condition that is not attracted to said ferromagnetic container and a second magnetic condition that is attracted to said ferromagnetic container;

wherein each one of said permanent magnets includes two permanent magnets in parallel relationship that are relatively moveable to obtain a first relative magnetic alignment to obtain said first magnetic condition and a second relative magnetic alignment to obtain said second magnetic condition; and seal means for sealing between said frame means and said ferromagnetic container.

2. A seal device according to claim 1, further including a mounting for attaching each said permanent magnet to said frame means while allowing relative movement of said permanent magnet through said frame.

3. A seal device according to claim 1, wherein said seal means is a planar flexible material.

4. A seal device according to claim 1, wherein said seal means is a molded seal defining ribs of compressible material to accommodate relative movement between said frame means at different ones of each of said permanent magnets.

5. A seal device according to claim 1, further including latch means operatively connected to said frame for securing said frame and said bladder movement along the surface of said ferromagnetic container.

6. A seal device according to claim 6, wherein said latch means includes a rotatable arm housing a hardened pin for engaging said surface of said ferromagnetic container and spring means for urging said pin against said surface.

7. A seal device according to claim 6, wherein said latch means includes a rotatable arm housing a hardened pin for engaging said surface of said ferromagnetic container and supporting a surface effective to generate a drag force from fluid flowing over said surface of said ferromagnetic container, said drag force acting to rotate said rocker arm to engage said pin with said surface.

8. A seal device according to claim 7, further including a mounting for attaching each said permanent magnet to said frame means while allowing relative movement of said permanent magnet through said frame.

9. A seal device according to claim 7, wherein said seal means is planar flexible material.

10. A seal device according to claim 7, wherein said seal means is a molded seal defining ribs of compressible material to accommodate relative movement between said frame means at different ones of each of said permanent magnets.

11. A seal device according to claim 7, wherein said latch means includes a rotatable arm housing a hardened pin for engaging said surface of said ferromagnetic container and supporting a surface effective to generate a drag force from fluid flowing over said surface of said ferromagnetic container, said drag force acting to rotate said rocker arm to engage said pin with said surface.

12. A seal device for sealing about an area of a leak in the surface of a ferromagnetic container, comprising:

frame means defining an internal area larger than said area of said leak;

a bladder covering said internal area and secured to said frame means;

a plurality of permanent magnets spaced bout said frame means for magnetic attachment to said surface of said ferromagnetic container, each said permanent magnet having a first magnetic condition that is not attracted to said ferromagnetic container and a second magnetic condition that is attracted to said ferromagnetic container;

latch means including a rotatable arm housing a hardened pin for engaging said surface of said ferromagnetic container and spring means for urging said pin against said surface for securing said frame and said bladder from movement along the surface of said ferromagnetic container; and seal means for sealing between said frame means and said ferromagnetic container.

* * * * *